US009705236B2

(12) United States Patent
Horiuchi et al.

(10) Patent No.: US 9,705,236 B2
(45) Date of Patent: Jul. 11, 2017

(54) CONNECTOR WITH SEAL RING HAVING EAR-LIKE PROTRUDING PORTIONS

(71) Applicant: Sumitomo Wiring Systems, Ltd., Yokkaichi, Mie (JP)

(72) Inventors: Hidefumi Horiuchi, Mie (JP); Hideto Nakamura, Mie (JP)

(73) Assignee: Sumitomo Wiring Systems, Ltd., Yokkaichi, Mie (JP)

( * ) Notice: Subject to any disclaimer, the term of this patent is extended or adjusted under 35 U.S.C. 154(b) by 0 days.

(21) Appl. No.: 14/782,604

(22) PCT Filed: Feb. 24, 2014

(86) PCT No.: PCT/JP2014/054325

§ 371 (c)(1),
(2) Date: Oct. 6, 2015

(87) PCT Pub. No.: WO2014/174883

PCT Pub. Date: Oct. 30, 2014

(65) Prior Publication Data

US 2016/0043498 A1 Feb. 11, 2016

(30) Foreign Application Priority Data

Apr. 26, 2013 (JP) ..... 2013-094494

(51) Int. Cl.
*H01R 13/52* (2006.01)

(52) U.S. Cl.
CPC ..... *H01R 13/5202* (2013.01); *H01R 13/5219* (2013.01)

(58) Field of Classification Search
CPC ..... H01R 13/5202; H01R 13/5219
USPC ..... 439/271, 272, 587, 589
See application file for complete search history.

(56) References Cited

FOREIGN PATENT DOCUMENTS

| | | |
|---|---|---|
| JP | 2004-14426 | 1/2004 |
| JP | 2004-186079 | 7/2004 |
| JP | 2005-5135 | 1/2005 |
| JP | 2009-193903 | 8/2009 |

OTHER PUBLICATIONS

International Search Report.

*Primary Examiner* — Gary Paumen
*Assistant Examiner* — Paul Baillargeon
(74) *Attorney, Agent, or Firm* — Gerald E. Hespos; Michael J. Porco; Matthew T. Hespos

(57) ABSTRACT

A connector includes a substantially rectangular seal ring (30) with four corners formed by arcuate portions (34). Ear-like protruding portions (36) are formed on the seal ring (30) to extend along the arcuate portions (34) on the four corners and project toward an outer periphery. The ear-like protruding portions (36) are configured to regulate rattling in a connecting direction of first and second housings (10, 20) by being resiliently compressed between a back end surface (16S) of a connection space (16) of the first housing (10) and a tip surface (22S) of a receptacle (22) of the second housing (20) with the first and second housings (10, 20) connected. Pressure receiving portions (38A, 38B) project from surfaces of the ear-like protruding portions (36) facing the receptacle (22) and are divided in a circumferential direction by grooves (39).

9 Claims, 8 Drawing Sheets

CONNECTOR WITH SEAL RING HAVING EAR-LIKE PROTRUDING PORTIONS

BACKGROUND

1. Field of the Invention

The present invention relates to a connector.

2. Description of the Related Art

Japanese Unexamined Patent Publication No. 2005-005135 discloses a connector with a first housing formed with a connection space between a terminal accommodating portion and a tubular fitting portion, a second housing including a receptacle to be inserted into the connection space and a seal ring to be accommodated into the connection space and configured to seal a clearance between the outer periphery of the terminal accommodating portion and the inner periphery of the receptacle. The seal ring is substantially rectangular as a whole and is formed by connecting four straight line portions by arcuate portions on four corners. The seal ring is formed with ear-like flanges extending along the four arcuate portions and protruding toward an outer peripheral side. In a state where the two housings are connected, rattling in a connecting direction of the two housings is regulated by resilient restoring forces of the flanges resiliently compressively deformed between the back end surface of the connection space and a tip part of the receptacle.

In the above connector, inclination between the two housings in two-dimensional directions perpendicular to the connecting direction of the two housings also is prevented by arranging the flanges on the four corners of the seal ring. To enhance this inclination preventing function in the two-dimensional directions, it is desirable to ensure wide formation areas of the flanges in a circumferential direction. However, if the flanges are made longer in the circumferential direction, the volume of the flanges is increased by that much and the resilient restoring forces of the flanges increase. Thus, connection resistance in a final stage of the process of connecting the two housings increases.

The present invention was completed based on the above situation and aims to combine an improvement of an inclination preventing function between housings and a reduction of connection resistance.

SUMMARY

A connector of the invention includes a first housing with a terminal accommodating portion surrounded by a tubular fitting. A connection space is formed between the terminal accommodating portion and the tubular fitting. A second housing has a receptacle to be inserted into the connection space. The connector further includes a seal ring having a substantially rectangular shape with four corners formed by arcuate portions. The seal ring is configured to seal a clearance between an outer periphery of the terminal accommodating portion and an inner periphery of the receptacle by being mounted on the outer periphery of the terminal accommodating portion. Ear-like protruding portions are formed on the seal ring to extend along the arcuate portions on the four corners and project toward an outer peripheral side. The protruding portions are configured to regulate rattling in a connecting direction of the first and second housings by being resiliently compressively deformed between a back end surface of the connection space and a tip surface of the receptacle with the first and second housings connected. Pressure receiving portions project from surfaces of the ear-like protruding portions facing the receptacle and are divided in a circumferential direction by grooves.

An area of the ear-like protruding portion to be held in contact with the receptacle is divided in the circumferential direction into the plurality of pressure receiving portions by the groove. Thus, an increase of the volume of a part of the ear-like protruding portion to be compressively deformed can be suppressed by as much as the groove even if a formation range of the ear-like protruding portion in the circumferential direction is enlarged. Thus, a function of preventing inclination between the housings can be improved and, at the same time, connection resistance in a final stage of the process of connecting the two housings can be reduced.

Protrusions may be formed on a surface of the ear-like protruding portion facing the back end surface of the connection space and may project from areas corresponding to the pressure receiving portions. The pressure receiving portions of the ear-like protruding portion mainly are deformed compressively. As a ratio of a projection distance of the pressure receiving portions to an area of projecting end surfaces of the pressure receiving portions increases, the pressure receiving portions are buckled during compression and the two housings easily are displaced improperly. Accordingly, in the present invention, the protrusions are formed back-to-back with the pressure receiving portions on the ear-like protruding portion and a compressive deformation amount of the ear-like protruding portion in the connecting direction is shared by the pressure receiving portions and the protrusions. Since the projection distances of the pressure receiving portions and the protrusions are suppressed relatively short in this way, there is no possibility of buckling.

The connector may include accommodation recesses formed by recessing the back end surface of the connection space and configured so that at least parts of the ear-like protruding portions are accommodated therein and held in contact therewith. According to this configuration, at least parts of the ear-like protruding portions are accommodated into and held in contact with the accommodation recesses, thereby positioning the ear-like protruding portions with respect to the first housing.

Plural protrusions may be formed on a surface of the ear-like protruding portion facing the back end surface of the connection space and may project from areas corresponding to the plurality of pressure receiving portions. Additionally, the accommodation recess may include a plurality of accommodation spaces configured to accommodate the plurality of protrusions and a communication space allowing communication between adjacent ones of the accommodation spaces. According to this configuration, parts of the protrusions can enter the communication space when being compressively deformed so that the compressive deformation of the protrusions is not obstructed. Thus, an increase of the connection resistance in the final stage of the process of connecting the two housings can be avoided.

The accommodation recess may include an excess space communicating with the accommodation space and functioning as a deflection space for the protrusions. According to this configuration, since it becomes more difficult to obstruct the compressive deformation of the protrusions, an increase of the connection resistance in the final stage of the process of connecting the two housings can be effectively avoided.

Inner surfaces of the accommodation spaces may be in surface contact with or proximately facing inner and outer peripheral surfaces of the protrusions. Thus, the ear-like protruding portions including the protrusions are positioned with respect to the first housing.

DETAILED DESCRIPTION

One specific embodiment of the present invention is described with reference to FIGS. 1 to 10. A connector of this embodiment includes a first housing 10 made of synthetic resin, a second housing 20 made of synthetic resin and a seal ring 30 made of rubber. Note that, in the following description, a left side in FIG. 2 is defined as a front side concerning a front-back direction.

Figure 1:
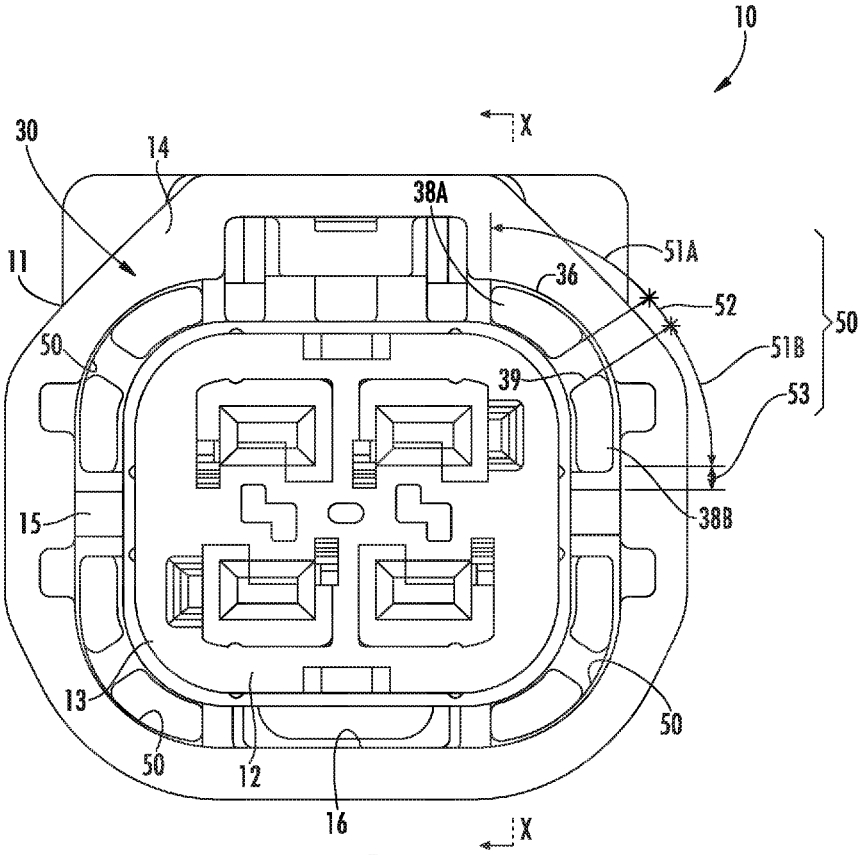
FIG. 1 is a front view showing a state where a seal ring is mounted on a first housing in one embodiment.
Figure 2:
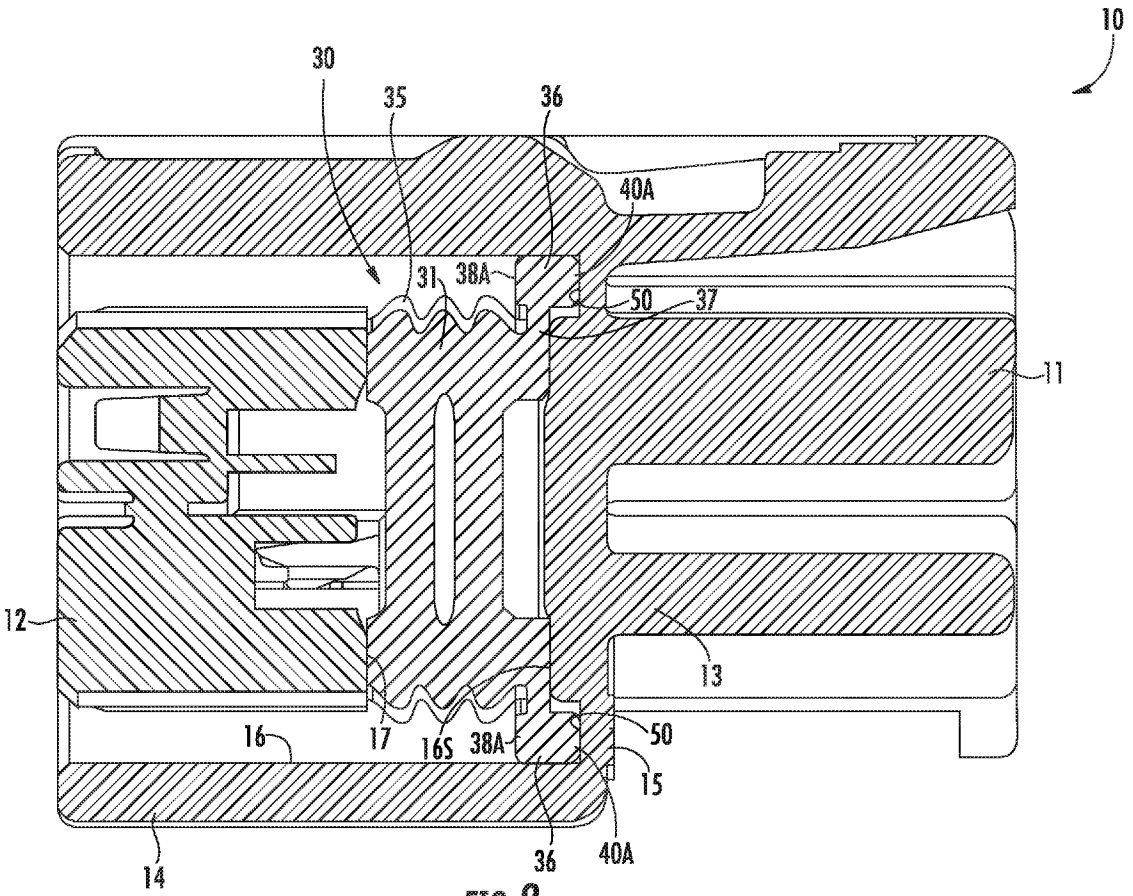
FIG. 2 is a section along X-X of FIG. 1.

As shown in FIG. 2, the first housing 10 includes, as constituent components, an outer housing 11 and an inner housing 12 to be assembled with the outer housing 11 from front. The first housing 10 is configured, in terms of shape, by integrally forming a block-like terminal accommodating portion 13 and a tubular fitting portion 14 surrounding the terminal accommodating portion 13 over the entire circumference. The terminal accommodating portion 13 is composed of a part of the outer housing 11 and the inner housing 12, and female terminal fittings (not shown) of a known form are accommodated in the terminal accommodating portion 13. The tubular fitting portion 14 is formed in the outer housing 11.

[A rear end part of the tubular fitting portion 14 and the outer periphery of the terminal accommodating portion 13 are connected by a supporting portion 15 in the form of a flange protruding from the outer periphery of the terminal accommodating portion 13. A space between the outer periphery of the terminal accommodating portion 13 and the inner periphery of the tubular fitting portion 14 serves as a tubular connection space 16 open on the front end surface of the first housing 10. The front surface of the supporting portion 15 constitutes a back end surface 16S of the connection space 16. Further, an area from the rear end of the inner housing 12 to the back end of the connection space 16 is recessed over the entire circumference in a rear end area of the outer periphery of the terminal accommodating portion 13, thereby forming a seal groove 17.

Figure 10:
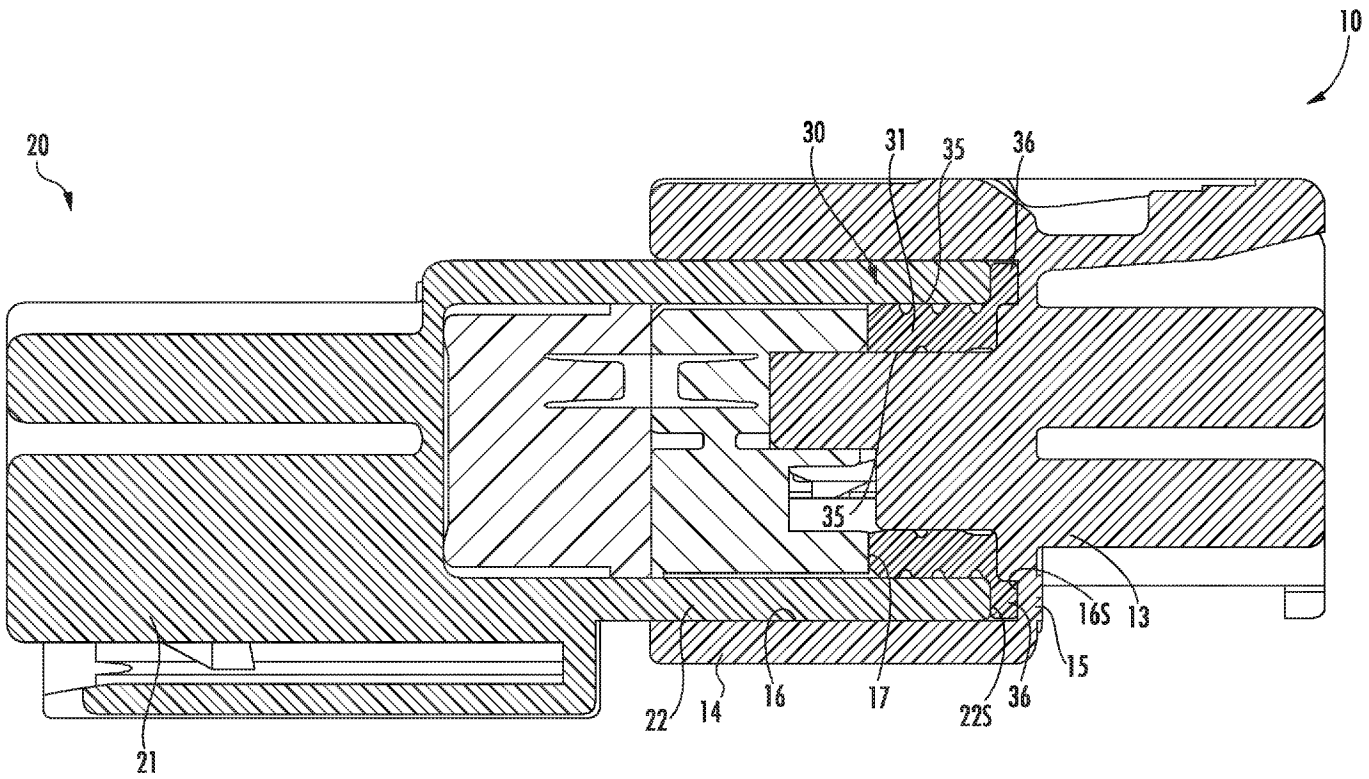
FIG. 10 is a section showing a state where the first and second housings are connected.

As shown in FIG. 10, the second housing 20 is configured by integrally forming a terminal holding portion 21 and a tubular receptacle 22 projecting from the terminal holding portion 21 toward a front surface side (direction facing the first housing 10). Male terminal fittings (not shown) of a known form are mounted in the terminal holding portion 21 and tabs on the tips of the male terminal fittings are surrounded by the receptacle 22. A tip surface 22S of the receptacle 22 is a flat surface perpendicular to a connecting direction of the two housings 10, 20.

Figure 6:
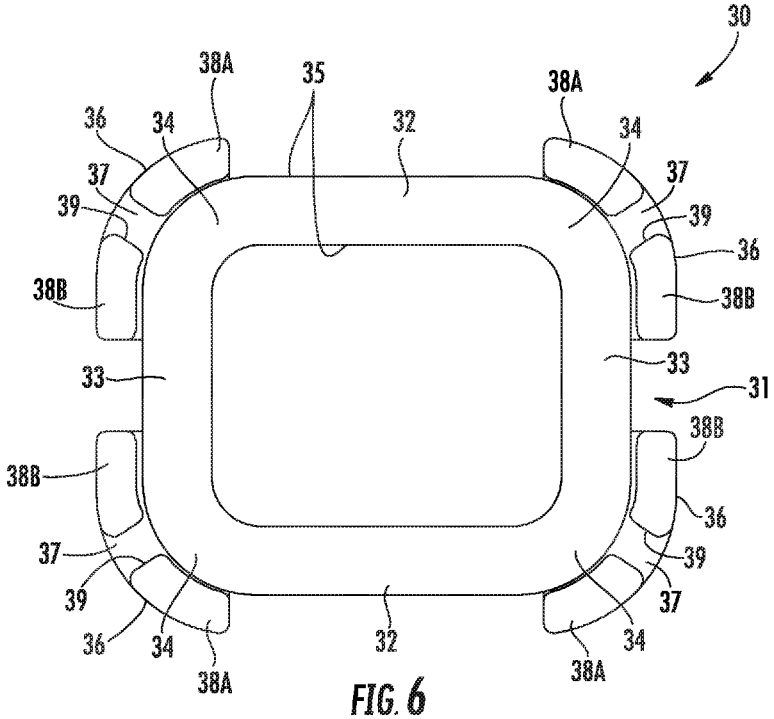
FIG. 6 is a front view of the seal ring.
Figure 7:
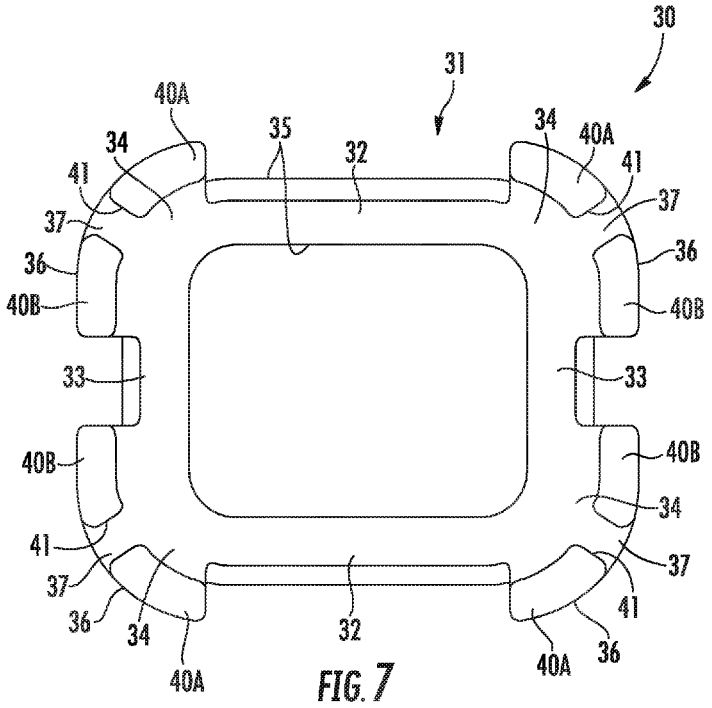
FIG. 7 is a rear view of the seal ring.

As shown in FIGS. 6 and 7, the seal ring 30 is configured by integrally forming a ring main body portion 31 substantially in the form of a rectangular tube as a whole and four ear-like protruding portions 36 projecting from the outer periphery of the rear end of the ring main body portion 31. The ring main body portion 31 is composed of a pair of upper and lower plate-like horizontal portions 32, a pair of left and right plate-like side surface portions 33 and quarter-circular arcuate portions 34 arranged on four corners to connect the horizontal portions 32 and the side surface portions 33. Lip portions 35 are formed on each of the inner and outer peripheral surfaces of the ring main body portion 31. As shown in FIG. 10, the seal ring 30 is mounted on the outer periphery of the terminal accommodating portion 13 with the ring main body portion 31 fitted in the seal groove 17. With the seal ring 30 mounted, the lip portions 35 on the inner periphery of the ring main body portion 31 are resiliently held in close contact with the outer peripheral surface of the terminal accommodating portion 13 (groove bottom surface of the seal groove 17).

Figure 5:
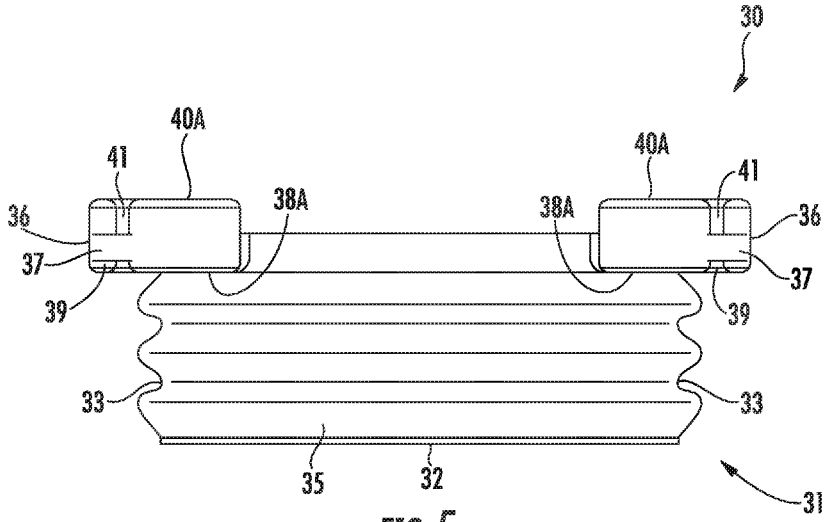
FIG. 5 is a plan view of the seal ring.
Figure 8:
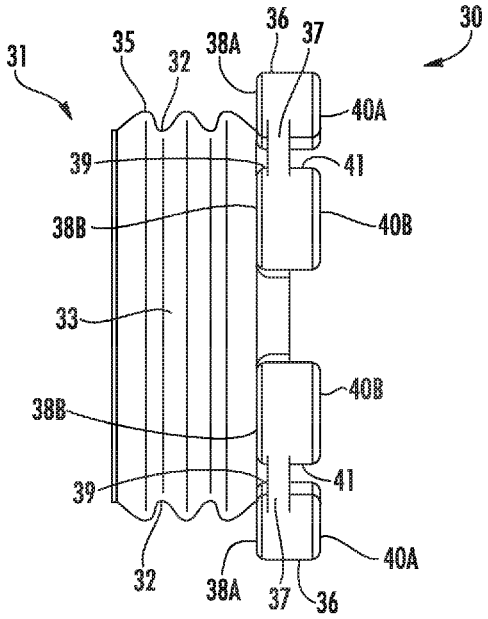
FIG. 8 is a side view of the seal ring.
Figure 9:
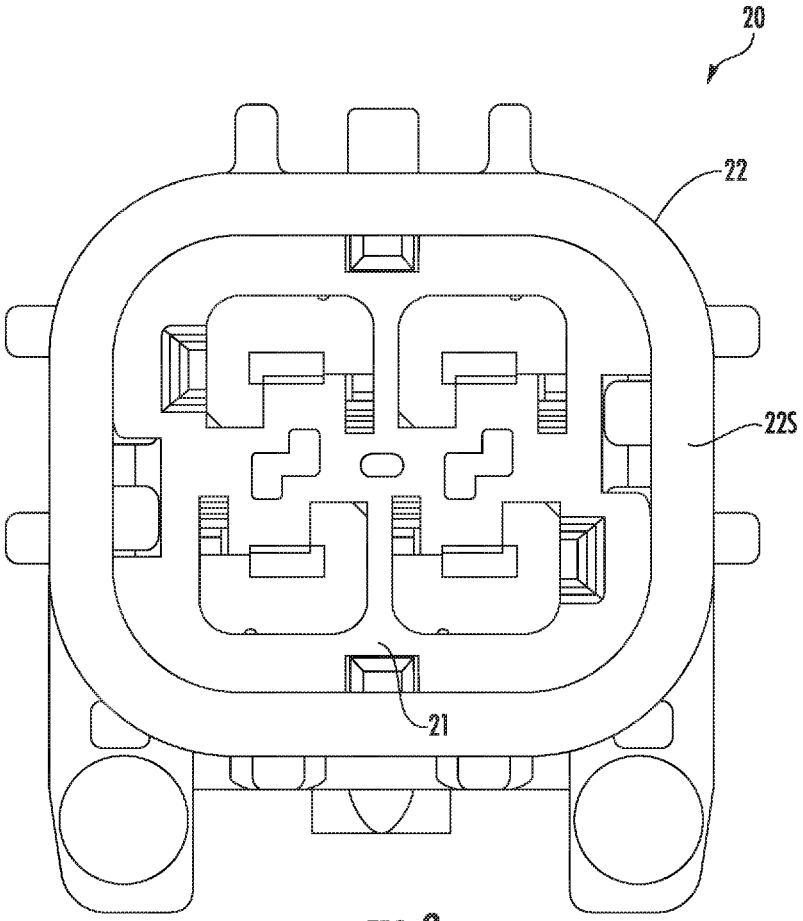
FIG. 9 is a front view of a second housing.

As shown in FIGS. 5 and 8, the four ear-like protruding portions 36 are arranged on a rear end part of the ring main body portion 31 in the front-back direction (direction parallel to the connecting direction of the two housings 10, 20). As shown in FIGS. 6 and 7, the four ear-like protruding portions 36 are vertically and bilaterally symmetrically arranged. A pair of left and right upper ear-like protruding portions 36 are in the form of flanges formed in areas along the entire outer peripheries of the upper arcuate portions 34 and areas along upper end parts of the outer peripheries of the side surface portions 33 and projecting toward an outer peripheral side from the ring main body portion 31. A pair of left and right lower ear-like protruding portions 36 are in the form of flanges formed in areas along the entire outer peripheries of the lower arcuate portions 34 and areas along lower end parts of the outer peripheries of the side surface portions 33 and projecting toward the outer peripheral side from the ring main body portion 31.

Each ear-like protruding portion 36 is configured by integrally forming an ear-like (flange-like) plate-like portion 37 flush with the rear end surface of the ring main body portion 31 and protruding toward the outer peripheral side, two first and second pressure receiving portions 38A, 38B formed on the plate-like portion 37 and two first and second protrusions 40A, 40B formed on the plate-like portion 37.

The two pressure receiving portions 38A, 38B are formed to project from parts of the front surface (surface facing the receptacle 22) of the plate-like portion 37 as shown in FIGS. 5 and 8 and divided in a circumferential direction by a groove portion 39 as shown in FIG. 6. A formation area of the first pressure receiving portion 38A (pressure receiving portion as claimed) in the circumferential direction is a range corresponding only to the arcuate portion 34. Further, a formation area of the second pressure receiving portion 38B (pressure receiving portion as claimed) in the circumferential direction is a range corresponding to a part of the arcuate portion 34 and a part of the side surface portion 33. Thus, the groove portion 39 corresponds only to a part of the arcuate portion 34. As shown in FIGS. 5 and 8, the front surfaces (projecting end surfaces) of the pressure receiving portions 38A, 38B are flat surfaces parallel to the front surface of the plate-like portion 37 and perpendicular to the connecting direction of the two housings 10, 20. Projection distances of the first and second pressure receiving portion 38A, 38B from the front surface of the plate-like portion 37 are equal.

Lengths of the first and second pressure receiving portions 38A, 38B are set equal to each other. Further, a length of one pressure receiving portion 38A, 38B in the circumferential direction is set longer than a groove width of the groove portion 39 (distance between the two pressure receiving portions 38A, 38B). An end surface opposite to the groove portion 39 out of opposite circumferential end surfaces of the first pressure receiving portion 38A and an end surface opposite to the groove portion 39 out of opposite circumferential end surfaces of the second pressure receiving portion 38B are continuous and flush with circumferential end surfaces of the plate-like portion 37. The outer peripheral surfaces of the pressure receiving portions 38A, 38B are continuous and flush with the outer peripheral surface of the plate-like portion 37.

The first protrusion 40A (protrusion as claimed) is formed to partly project only from an area of the rear surface of the plate-like portion 37 (surface facing the back end surface 16S of the connection space 16) corresponding to the first pressure receiving portion 38A and the second protrusion 40B (protrusion as claimed) is formed to partly project only from an area of the rear surface of the plate-like portion 37 corresponding to the second pressure receiving portion 38B. As shown in FIG. 7, the two protrusions 40A, 40B are divided in the circumferential direction by a cut portion 41.

Lengths of the first and second protrusions 40A, 40B in the circumferential direction are set substantially equal to each other. A length of one protrusion 40A, 40B in the circumferential direction is set longer than a width of the cut portion 41 (distance between the two protrusions 40A, 40B). An end surface opposite to the cut portion 41 out of opposite circumferential end surfaces of the first protrusion 40A and an end surface opposite to the cut portion 41 out of opposite circumferential end surfaces of the second protrusion 40B are continuous and flush with the circumferential end surfaces of the plate-like portion 37. The outer peripheral surfaces of the protrusions 40A, 40B are continuous and flush with the outer peripheral surfaces of the plate-like portion 37 and the pressure receiving portions 38A, 38B.

As shown in FIGS. 7 and 8, the rear surfaces (projecting end surfaces) of the protrusions 40A, 40B are flat surfaces parallel to the rear surface of the plate-like portion 37 and perpendicular to the connecting direction of the two housings 10, 20. The rear surface of the plate-like portion 37 is continuous and flush with the rear surface of the ring main body portion 31. Thus, as shown in FIG. 8, the protrusions 40A, 40B project further backward than the rear end surface of the ring main body portion 31. As shown in FIGS. 5 and 8, projection distances of the first and second protrusion 40A, 40B from the rear surface of the plate-like portion 37 are equal. The projection distances of the first and second protrusion 40A, 40B from the rear surface of the plate-like portion 37 are set longer than those of the pressure receiving portions 38A, 38B from the front surface of the plate-like portion 37.

Figure 3:
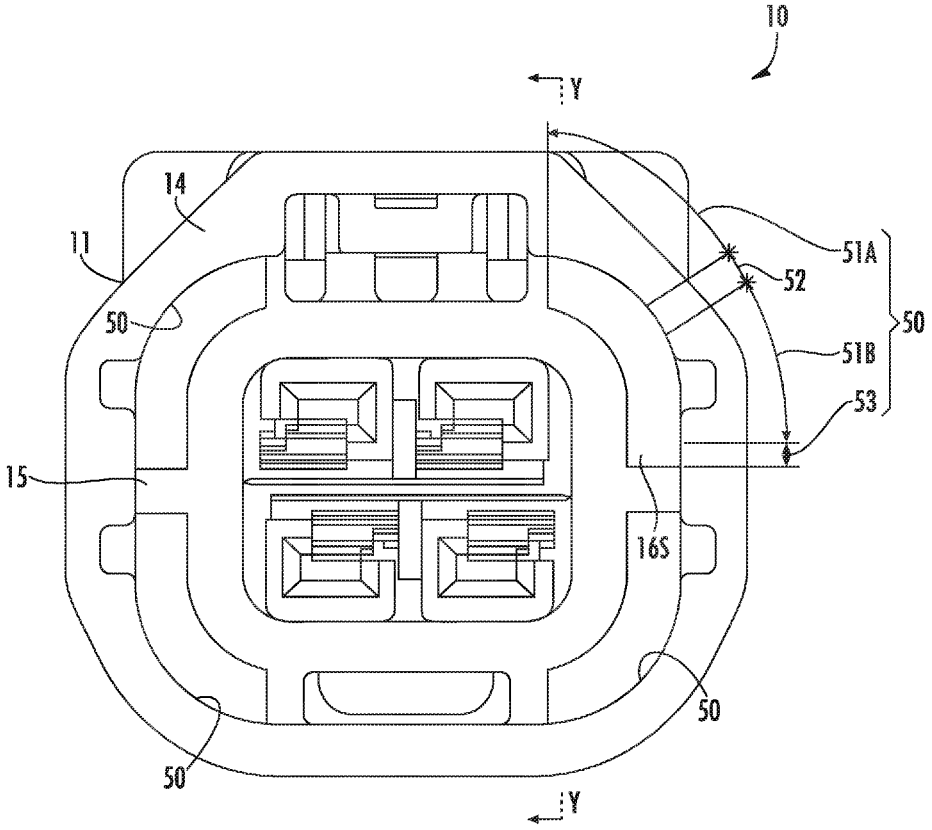
FIG. 3 is a front view of an outer housing constituting the first housing.
Figure 4:
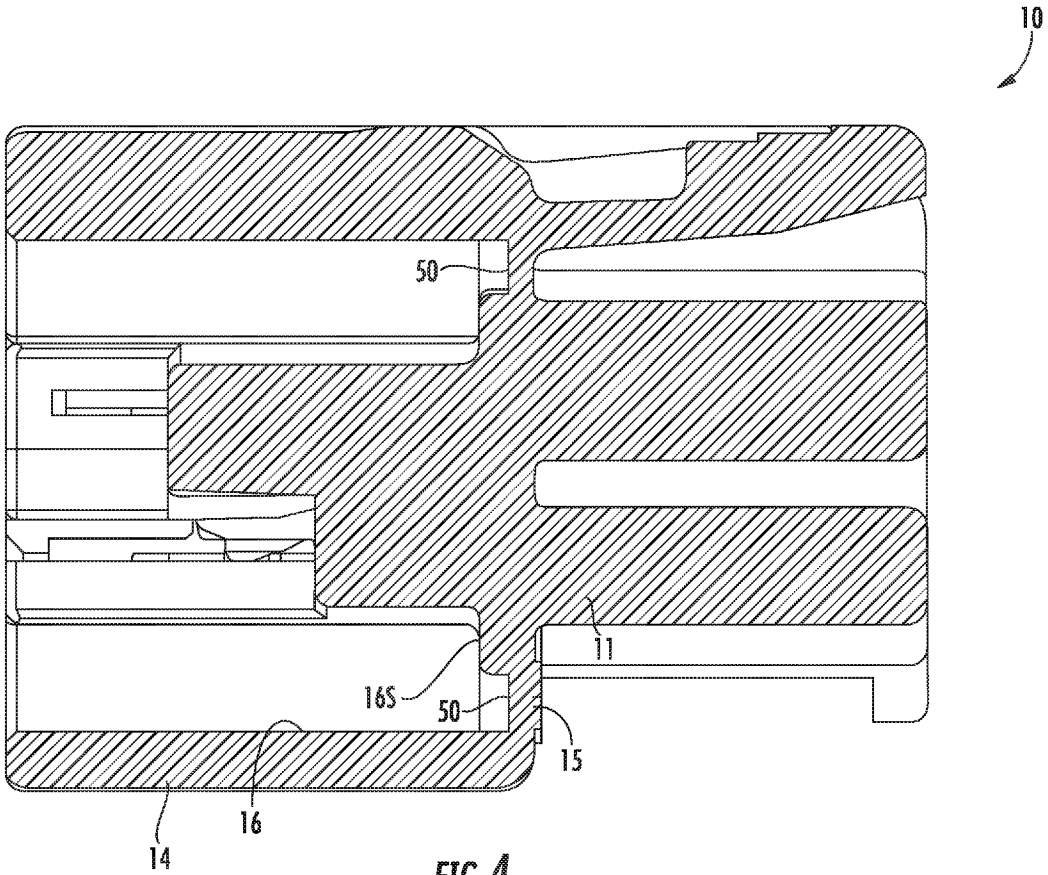
FIG. 4 is a section along Y-Y of FIG. 3.

Further, as shown in FIGS. 2 and 3, the first housing 10 is formed with accommodation recesses 50 at four separate positions corresponding to the four ear-like protruding portions 36 by partly recessing the back end surface 16S of the connection space 16. One accommodation recess 50 is formed to be long and narrow in the circumferential direction by a first accommodation space 51A (accommodation space as claimed), a second accommodation space 51B (accommodation space as claimed), a communication space 52 and an excess space 53.

The first protrusion 40A of the corresponding ear-like protruding portion 36 is accommodated into the first accommodation space 51A. The second protrusion 40B of the corresponding ear-like protruding portion 36 is accommodated into the second accommodation space 51B. The communication space 52 allows communication between the two accommodation spaces 51A, 51B adjacent in the circumferential direction. The excess space 53 communicates with an end part of the second accommodation space 51B opposite to the communication space 52. Inner surfaces of the first accommodation space 51A are in surface contact with or proximately facing the inner and outer peripheral surfaces of the first protrusion 40A. Similarly, inner surfaces of the second accommodation space 51B are in surface contact with or proximately facing the inner and outer peripheral surfaces of the second protrusion 40B. The communication space 52 corresponds to the cut portion 41.

When the first and second housings 10, 20 are connected, the receptacle 22 is inserted into the connection space 16, the lip portions 35 on the outer peripheral side of the seal ring 30 are held in close contact with the inner periphery of the receptacle 22 and the lip portions 35 on the inner peripheral side of the seal ring 30 are held in close contact with the outer periphery of the terminal accommodating portion 13. In this way, a clearance between the outer peripheral surface of the terminal accommodating portion 13 and the inner peripheral surface of the receptacle 22 is sealed in a liquid-tight manner by the seal ring 30.

Similarly, with the two housings 10, 20 connected, the tip surface 22S of the receptacle 22 resiliently presses the pressure receiving portions 38A, 38B of the ear-like protruding portions 36 from front and that pressing force is received by the back end surface 16S of the connection space 16 (back bottom surface of the accommodation recesses 50). Since a distance between the tip surface 22S of the receptacle 22 and the back end surface 16S of the connection space 16 is shorter than a thickness in the front-back direction of the ear-like protruding portions 36 not resiliently deformed, the ear-like protruding portions 36 are resiliently squeezed.

At this time, not the plate-like portions 37, but the pressure receiving portions 38A, 38B and the protrusions 40A, 40B are mainly compressively deformed. The reason for this is as follows. First, the sum of the two pressure receiving portions 38A, 38B and the sum of the two protrusions 40A, 40B are smaller than the entire area of the plate-like portion 37 in cross-sectional area perpendicular to a compressing direction. Further, the outer and inner peripheral surfaces of the plate-like portion 37 are respectively held in contact with or proximately facing the inner peripheral surface of the tubular fitting portion 14 and the outer peripheral surface of the terminal accommodating portion 13, and deflection spaces for accommodating excess parts produced when the plate-like portion 37 is compressively deformed are not secured at the inner and outer peripheral sides of the plate-like portion 37.

On the other hand, for the pressure receiving portions 38A, 38B, deflection spaces including the groove portion 39 for accommodating excess parts produced during compressive deformation are secured at the opposite circumferential end sides of the pressure receiving portions 38A, 38B and deflection spaces for accommodating excess parts during compressive deformation are also secured between the pressure receiving portions 38A, 38B and the outer peripheral surface of the ring main body portion 31 at the inner peripheral sides of the pressure receiving portions 38A, 38B. Further, for the first protrusion 40A, the cut portion 41 and the communication space 52 function as deflection spaces for accommodating excess parts produced during the compressive deformation of the first protrusion 40A. Furthermore, for the second protrusion 40B, the cut portion 41, the communication space 52 and the excess space 53 function as deflection spaces for accommodating excess parts produced during the compressive deformation of the second protrusion 40B.

As just described, when the ear-like protruding portions 36 are pressed and squeezed in the front-back direction to be resiliently compressively deformed between the tip surface 22S of the receptacle 22 and the back end surface 16S of the connection space 16, rattling between the two housings 10, 20 in the front-back direction is prevented by the resilient restoring forces of the ear-like protruding portions 36. Further, the ear-like protruding portions 36 are distributed at the arcuate portions 34 on the four corners of the seal ring 30 substantially in the form of a rectangular tube and symmetrically shaped and arranged with respect to the vertical and lateral directions. Thus, the inclination of the two housings 10, 20 about a lateral axis and the inclination of the two housings 10, 20 about a vertical axis are also reliably regulated. Since the resilient restoring forces of the four ear-like protruding portions 36 are kept in a uniform state, a function of preventing the rattling between the two housings 10, 20 is stabilized.

As just described, in this embodiment, the four ear-like protruding portions 36 are arranged on the four corners of the seal ring 30 to prevent the inclination between the two housings 10, 20 in the two-dimensional directions perpendicular to the connecting direction of the two housings 10, 20. It is desirable to ensure formation areas wide in the circumferential direction for the ear-like protruding portions 36 to enhance this inclination preventing function in the two-dimensional directions. However, if the entire ear-like protruding portion 36 is made long in the circumferential direction, the volume thereof to be compressively deformed increases to increase the resilient restoring force. Thus, connection resistance resulting from the resilient restoring force of the ear-like protruding portion 36 increases in a final stage of the process of connecting the two housings 10, 20.

Accordingly, in this embodiment, the two pressure receiving portions 38A, 38B projecting from the surface of the ear-like protruding portion 36 facing the receptacle 22 and divided in the circumferential direction by the groove portion 39 are provided as means for combining an improvement of the inclination preventing function between the two housings 10, 20 and a reduction of the connection resistance. According to this configuration, even if the formation range of the ear-like protruding portion 36 in the circumferential direction is enlarged, an increase of the volume of a part of the ear-like protruding portion 36 to be compressively deformed can be suppressed by as much as the groove portion 39. Thus, it can be realized to improve the function of preventing the inclination between the two housings 10, 20 and, at the same time, reduce the connection resistance in the final stage of the process of connecting the two housings 10, 20.

Further, in the connector of this embodiment, the two protrusions 40A, 40B projecting from the areas corresponding to the two pressure receiving portions 38A, 38B are formed on the surface (rear surface) of the ear-like protruding portion 36 facing the back end surface 16S of the connection space 16. If the ear-like protruding portion 36 is not formed with the protrusions 40A, 40B, the pressure receiving portions 38A, 38B of the ear-like protruding portion 36 are mainly compressively deformed. In this case, as a ratio of the projection distance of the pressure receiving portions 38A, 38B from the plate-like portion 37 to an area of the front surfaces (projecting end surfaces) of the pressure receiving portions 38A, 38B increases, the pressure receiving portions 38A, 38B are improperly deformed such as to be buckled during compression and the two housings 10, 20 are easily improperly displaced.

Accordingly, in this embodiment, the ear-like protruding portion 36 is formed with the protrusions 40A, 40B projecting in a back-to-back positional relationship with the pressure receiving portions 38A, 38B and the compressive deformation amount of the ear-like protruding portion 36 in the connecting direction (front-back direction) is shared by the pressure receiving portions 38A, 38B on the front side and the protrusions 40A, 40B on the rear side. Since the projection distances of the pressure receiving portions 38A, 38B and protrusions 40A, 40B are suppressed relatively short by this in this embodiment, there is no possibility of buckling.

Further, the connector of this embodiment is formed with the accommodation recesses 50 formed by recessing the back end surface 16S of the connection space 16 and configured such that the protrusions 40A, 40B of the ear-like protruding portions 36 are accommodated thereinto and held in contact therewith. According to this configuration, the end surfaces opposite to the cut portion 41 out of the opposite circumferential end surfaces of the first protrusions 40A are held in contact with the inner surfaces of the accommodation recesses 50 in the circumferential direction (leftward or rightward direction) and the inner and outer peripheral surfaces of the second protrusions 40B are held in contact with the inner surfaces of the accommodation recesses 50, whereby the ear-like protruding portions 36 are positioned in the lateral direction with respect to the first housing 10.

Further, the inner and outer peripheral surfaces of the first protrusions 40A are held in contact with the inner surfaces of the accommodation recesses 50, whereby the ear-like protruding portions 36 are positioned in diagonal directions of the seal ring 30 with respect to the first housing 10. Furthermore, the inner and outer peripheral surfaces of the first protrusions 40A are held in contact with the inner surfaces of the accommodation recesses 50 in a direction (substantially upward or downward direction) intersecting with the circumferential direction, whereby the ear-like protruding portions 36 are positioned in the vertical direction with respect to the first housing 10.

Further, since the protrusions 40A, 40B are accommodated in the accommodation recess 50 in this embodiment, the resilient deformation of the protrusions 40A, 40B may be obstructed by the interference with the inner surfaces of the accommodation recess 50 when the ear-like protruding portion 36 is compressively deformed. Accordingly, the communication space 52 allowing communication between the adjacent first and second accommodation spaces 51A, 51B is provided in the accommodation recess 50. According to this configuration, parts of the protrusions 40A, 40B can enter the communication space 52 when the protrusions 40A, 40B are compressively deformed. Thus, the compressive deformation of the protrusion 40A, 40B is not obstructed. Therefore, an increase of the connection resistance in the final stage of the process of connecting the two housings 10, 20 can be avoided.

The present invention is not limited to the above described and illustrated embodiment. For example, the following embodiments are also included in the technical scope of the present invention.

Although only one groove portion is formed on one ear-like protruding portion to have two pressure receiving portions in the above embodiment, a plurality of groove portions may be formed on one ear-like protruding portion to have three or more pressure receiving portions.

Although the protrusions corresponding to the pressure receiving portions are formed on the ear-like protruding portion in the above embodiment, the ear-like protruding portion may not be formed with the protrusions.

Although the accommodation recesses are formed on the back end surface of the connection space in the above embodiment, the accommodation recesses may not be formed on the back end surface of the connection space.

Although the accommodation recess is provided with the excess space in the above embodiment, the accommodation recess may be provided with no excess space.

LIST OF REFERENCE SIGNS

10 . . . first housing
13 . . . terminal accommodating portion
14 . . . tubular fitting portion
16 . . . connection space
16S . . . back end surface of connection space
20 . . . second housing
22 . . . receptacle
22S . . . tip surface of receptacle
30 . . . seal ring
34 . . . arcuate portion
36 . . . ear-like protruding portion
38A . . . first pressure receiving portion (pressure receiving portion)
38B . . . second pressure receiving portion (pressure receiving portion)
39 . . . groove portion
40A . . . first protrusion (protrusion)
40B . . . second protrusion (part)
50 . . . accommodation recess
51A . . . first accommodation space (accommodation space)
51B . . . second accommodation space (accommodation space)
52 . . . communication space
53 . . . excess space

The invention claimed is:

1. A connector, comprising:

a first housing having a terminal accommodating portion, a support extending out from the terminal accommodating portion and a tubular fitting extending forward from the support and surrounding the terminal accommodating portion;

a connection space formed between the terminal accommodating portion and the tubular fitting and forward of the support;

a second housing including a receptacle to be inserted into the connection space;

a seal ring having a substantially rectangular shape with four arcuate corners and configured to seal a clearance between an outer periphery of the terminal accommodating portion and an inner periphery of the receptacle by being mounted on the outer periphery of the terminal accommodating portion;

ears protruding on the seal ring to extend along the arcuate corners and projecting toward an outer peripheral side, each of the ears having a rear face engaging a front surface of the support at a back end of the connection space and a front face engaging a tip surface of the receptacle when the first and second housings are connected, the ears regulating rattling in a connecting direction of the first and second housings by being resiliently compressively deformed between the front surface of the support at a back end of the connection space and the tip surface of the receptacle with the first and second housings connected;

pressure receiving portions projecting forward at the front surfaces of each of the ears and divided in a circumferential direction by front grooves; and protrusions projecting rearward at the rear surfaces of each of the ears at circumferential positions corresponding to the pressure receiving portions and being divided by rear grooves.

2. The connector of claim 1, further comprising accommodation recesses formed by recessing a front surface of the support facing into the connection space and configured such that at least parts of the ears are accommodated therein and held in contact therewith.

3. The connector of claim 2, wherein:

each of the accommodation recesses includes accommodation spaces configured to accommodate the protrusions and a communication space allowing communication between adjacent ones of the accommodation spaces.

4. The connector of claim 3, wherein each of the accommodation recesses includes an excess space communicating with the accommodation space and functioning as a deflection space for the protrusions.

5. The connector of claim 4, wherein inner surfaces of the accommodation spaces are in surface contact with or proximately facing inner and outer peripheral surfaces of the protrusions.

6. The connector of claim 3, wherein inner surfaces of the accommodation spaces are in surface contact with or proximately facing inner and outer peripheral surfaces of the protrusions.

7. The connector of claim 1, wherein each of the ears has a plate having a front surface forming parts of the front grooves between the pressure receiving portions of each of the ears and having a rear surface forming parts of the rear grooves between the protrusions of each of the ears.

8. The connector of claim 7, wherein the rear surface of the plate is aligned with a rear end of the seal ring.

9. The connector of claim 1, wherein a rearward projecting distance of each of the protrusions exceeds a forward projecting distance of each of the pressure receiving portions.

* * * * *